United States Patent [19]

Yoshihara

[11] Patent Number: 4,591,080

[45] Date of Patent: May 27, 1986

[54] ROTARY NOZZLE SYSTEM FOR METALLURGICAL VESSELS

[75] Inventor: Tetsuya Yoshihara, Yokohama, Japan

[73] Assignees: Nippon Kokan Kabushiki Kaisha, Tokyo; Nippon Rotary Nozzle Co., Ltd.; Kokan Kikai Kogyo Kabushiki Kaisha, both of Kawasaki; Tokyo Yogyo Kabushiki Kaisha, Tokyo, all of Japan

[21] Appl. No.: 560,997

[22] Filed: Dec. 13, 1983

[30] Foreign Application Priority Data

| | | | |
|---|---|---|---|
| Dec. 14, 1982 | [JP] | Japan | 57-217684 |
| Dec. 14, 1982 | [JP] | Japan | 57-217685 |
| Dec. 14, 1982 | [JP] | Japan | 57-187929 |
| Dec. 27, 1982 | [JP] | Japan | 57-227108 |
| Dec. 27, 1982 | [JP] | Japan | 57-195382[U] |
| Dec. 27, 1982 | [JP] | Japan | 57-195383[U] |
| Dec. 27, 1982 | [JP] | Japan | 57-195384[U] |
| Feb. 25, 1983 | [JP] | Japan | 58-29551 |

[51] Int. Cl.[4] ..... B22D 41/08

[52] U.S. Cl. ..... 222/598; 222/600

[58] Field of Search ..... 222/594, 597, 598, 599, 222/600, 548, 288, 278; 266/236, 239; 164/437, 488, 335

[56] References Cited

U.S. PATENT DOCUMENTS

| | | | |
|---|---|---|---|
| 3,850,351 | 11/1974 | Yoshihara | 222/598 |
| 3,856,189 | 12/1974 | Meier | 222/537 |
| 3,921,866 | 11/1975 | Palazzo | 222/598 X |
| 4,116,372 | 9/1978 | Horiguchi et al. | 222/600 |
| 4,314,659 | 2/1982 | Shapland | 222/598 X |
| 4,480,771 | 11/1984 | Meier | 222/598 |

FOREIGN PATENT DOCUMENTS

| | | | |
|---|---|---|---|
| 111571 | 9/1981 | Japan | 222/598 |
| 1449334 | 9/1976 | United Kingdom . | |

OTHER PUBLICATIONS

*Iron and Steel Engineer,* Sep. 1973, pp. 117–124, "Nippon Kokan's Rotary Nozzle System for Teeming and Continuous Casting".

*Primary Examiner*—Joseph J. Rolla
*Assistant Examiner*—David H. Bollinger
*Attorney, Agent, or Firm*—Fleit, Jacobson, Cohn & Price

[57] ABSTRACT

In a dual door type rotary nozzle system for metallurgical vessels, a bottom plate brick attached to the bottom shell of the vessel is adapted to be opened and closed by an inner door, and a slide plate brick slidable in surface-to-surface contact relation with the bottom plate brick is also adapted to be opened and closed by an outer door. The bottom plate brick is provided with a plurality of nozzle bores and is mounted in a case rotatably supported in the inner door by means of a bearing so that the bottom plate brick is manually rotated along with the case when the inner door is opened, thereby realizing a rotary nozzle system capable of easily and rapidly effecting the change operation of the nozzle bores of the bottom plate brick.

15 Claims, 22 Drawing Figures

ROTARY NOZZLE SYSTEM FOR METALLURGICAL VESSELS

BACKGROUND OF THE INVENTION

1. Field of the Invention

The present invention relates to a dual door type rotary nozzle system which is attached to the steel shell of a vessel for molten steel such as a ladle or tundish, whereby its slide plate brick is rotated so as to adjust the opening and closing or the degree of opening of a nozzle bore formed in a fixed bottom plate brick, and thereby to control the start, stop and rate of pouring of molten steel.

2. Description of the Prior Art

Rotary nozzle systems have been used widely with ladles for receiving the molten steel tapped from a converter to transport or pour the molten steel into molds, from tundishes for receiving the molten steel from a ladle to pour the molten steel into molds and the like.

Such a rotary nozzle system is generally mounted and supported on the base member fixed to the bottom shell of a molten steel vessel such as a ladle or tundish. The base member is fixedly fitted to the bottom shell of the vessel to enclose a top nozzle fitted in the vessel and having a nozzle bore, and a bottom plate brick is attached to the base member so as to align with the nozzle bore. A slide plate brick having a nozzle bore is pressed in surface-to-surface contact against the bottom plate brick by a support frame supported on the base member, and arranged along one side of the system is a drive unit for rotating the slide plate brick having a collector nozzle attached to its lower part within the support frame. In this way, the slide plate brick is rotated so as to adjust the degree of opening of the nozzle bore.

Included among the known rotary nozzles is a dual door type rotary nozzle in which an inner door including a bottom plate brick and an outer door including a slide plate brick are pivoted by hinges so as to open and close these bricks, and this type of nozzle has a number of features that the contacting or sliding surfaces of the top nozzle, the bottom plate brick and the slide plate brick can be exposed to permit the confirmation of any damages on the brick surfaces by the naked eye, so that there is no need to prepare any standby set for replacing or repairing the bricks, so that the operation is easy, and so on.

Generally, this dual door type rotary nozzle has its bottom plate brick in the inner door pivotably attached to a base member and the nozzle bore formed in the bottom plate brick is connected to a top nozzle projected from a molten steel vessel when the inner door is closed. Further, when the outer door is closed, a slide plate brick having one or more nozzle bores is held is close contact with the lower surface of the bottom plate brick by means of springs and the slide plate brick is rotated so as to adjust the degree of register between the nozzle bores (or the degree of opening). Also, it has recently been proposed to form two nozzle bores symmetrically in the bottom plate brick, and the bottom plate brick can be rotated so as to use the nozzle bores by selectively connecting them with the top nozzle and thereby increase the service life of the expensive bottom plate bricks. Typical details of such proposal being set forth in U.S. patent application Ser. No. 354,535 filed Mar. 4, 1982, now U.S. Pat. No. 4,498,611, the teachings of which are hereby incorporated by reference.

However, in the use of the dual door type rotary nozzle of the above type, the following problems have been encountered and their early solution has been sought.

(1) Due to the manual rotating operation of the gear case surrounding the bottom plate brick in the inner door, there have been disadvantages that its nozzle bore changing operation requires a great deal of effort and time.

(2) While the outer door including the slide plate brick is pivotably attached by a hinge to the base member fixedly attached to the bottom shell of the molten steel vessel so as to be opened and closed by means of the hinge, from the standpoint of safety control it is absolutely necessary that upon closing the outer door the bottom plate brick and the slide plate brick are held in close contact with each other so as to prevent the leakage of molten steel and the entry of air, and also the inner and outer doors are locked positively so as to prevent the doors from being opened during the pouring operation.

Thus, it has been the usual practice that when the doors are closed, they are threadedly locked by means of two upper and lower pins inserted through the base member and the outer door on the opposite side to the hinge of the outer door. With this type of locking mechanism employing pins, however, there is a disadvantage in that when the outer door is to be opened, it is difficult to remove the pins due to skewing caused between the pins and the engaging portions, and moreover the pins heated by the heat of the molten steel makes it impossible to touch the pins in sufficient time with the hands, hence making the operation difficult and requiring much time due to the small size of the pins. There are other disadvantages in that the locking mechanism for the pins is complicated and tends to be damaged easily.

(3) The dual door type rotary nozzle has its doors pivotably attached by the hinge to the base member attached to the bottom shell of the molten steel vessel, as mentioned previously, and the output from a reducer of a driving source, e.g., a motor, is transmitted through an intermediate gear to the gear of a rotor including the slide plate brick and provided in the outer door thereby rotating the rotor gear and hence the slide plate brick to adjust the opening of the nozzle.

In this case, due to the nonpivotability of the outer door owing to an interference between the gear of the rotor and the intermediate gear, it has been the usual practice with the opening and closing of the outer door that the intermediate gear is removed or the intermediate gear is shifted to disengage it with the rotor gear each time the outer door is to be opened or closed. However, there are a number of disadvantages that in the case of the former the weight of the intermediate gear is large and moreover the removing operation is difficult, thus requiring much time and labor for the operation, in that in the case of the latter the intermediate gear is exposed to a high temperature (about 300° C.) due to the radiation heat of the molten steel and its smooth shifting is frequently prevented.

(4) Since the dual door type rotary nozzle is attached to the bottom shell of the molten steel vessel, during operation the rotary nozzle is heated to an elevated temperature of about 300° C. by the radiation heat of the molten steel. This has the effect of heating and deteriorating the coiled springs adapted to hold the slide plate brick in close contact with the bottom plate brick through the rotor, and in order to prevent such a phenomenon air is supplied through the inlet hole formed in the outer wall of the outer door frame, circulated through the spring chamber and discharged to the outside through the other vent hole, thereby cooling the coiled springs.

However, while this cooling method is capable of satisfactorily cooling the coiled springs in the vicinity of the inlet hole through which air is supplied, due to the fact that during operation the coiled springs are compressed and the spring wire spacing is reduced (to 1 to 2 mm), the flow of the air is impeded with the result that the air heated during its passage through the spring chamber attains a considerably high temperature by the time it is discharged to the outside through the vent hole, and thus the coiled springs in the vicinity of the vent hole are practically not cooled entirely, thus causing variations in the cooling effect depending on the locations. As a result, there is a difference in performance between the coiled springs at places of good cooling effect and the coiled springs at places of bad cooling effect, and the pressing force on the rotor differs from one place to another, thus failing to hold the slide plate brick uniformly in close contact with the bottom plate brick and thereby causing leakage of the molten steel, the entry of air, or early wear and loss of the two bricks.

(5) The outer door for accommodating the slide plate brick and the rotor is pivotably attached to the base member by the hinge. In other words, a threaded pin consisting of a threaded portion and a supporting shaft portion is threadedly fitted in a threaded hole formed in each of the brackets on the base member, and a hole formed through each of the arms of the outer door is engaged with the supporting shaft portion directly or through a bearing thereby opening and closing the outer door.

With this type of hinge, however, due to the mechanism supporting the outer door by means of the end portion of the pin, the threaded pins are also rotated gradually during the opening and closing of the outer door, and moreover a change of shape is caused in the brackets of the base member if the weight of the door is large, thereby frequently displacing the door and preventing the slide plate brick from coming into proper register with the bottom plate brick. Also, once the door is displaced, it is impossible to bring the door back to the initial position through any fine adjustments of the threaded pins.

(6) The bottom plate brick cannot be made fast to the gear case by means of screws or the like in view of the gear case construction, and also the slide plate brick cannot be attached or made fast in view of the rotor construction. Therefor, there is the possibility of each of these plate bricks falling off the case or the rotor when the inner or outer door is opened, thus being dangerous and also tending to cause damage to these expensive plate bricks.

(7) The base member, to which the bottom plate brick is attached when the inner door is closed, is formed into a flat shape except that an annular stepped portion for receiving the bottom plate brick is formed along its inner peripheral edge, and an opening for receiving the top nozzle is formed at a position corresponding to the nozzle bore in the bottom plate brick. Therefore, a gap is formed between the lower surface of the base member and the upper surface of the bottom plate brick when the bottom plate brick is mounted in position.

Since the slide plate brick is pressed closely against the bottom plate brick by the springs as mentioned previously, excepting the nozzle bore portion backed up by the top nozzle, the slide plate brick cannot be pressed closely against the remaining part of the bottom plate brick due to the gap or the relief allowance, with the result that the interfacial pressure becomes unstable and there are instances where the bottom plate brick is deformed. As a result, the molten steel enters at the sliding surfaces of the bottom plate brick and the slide plate brick so that the bricks are damaged and their lives are reduced. Particularly in the case of the dual door type rotary nozzle system wherein the bottom plate brick is formed with two nozzle bores for the purpose of changing bores, such defects are manifested more markedly with the result that not only operation is impeded but also the frequency of repair and replacement of the expensive bottom and slide plate bricks is increased.

(8) Since the base member is welded to the bottom shell of the molten steel vessel, when it is desired to remove the entire system from the molten steel vessel for inspecting or replacing purposes, the entire system cannot be removed easily and the restoration operation takes time, thus giving rise to the danger of making it impossible to use the molten steel vessel over a long period of time and impeding operation.

OBJECT OF THE INVENTION

The present invention has been made with a view to overcoming the foregoing deficiencies in the prior art and its objects are summarized as follows.

(1) In a dual door type rotary nozzle system being provided with a bottom plate brick having two or more nozzle bores, the improvement wherein the bottom plate brick is mounted in a support case rotatably supported in an inner door by means of a bearing means so as to rotate manually the bottom plate brick along with the support case when the inner door is opened, thereby realizing a rotary nozzle capable of easily and rapidly effecting the changing operation of the nozzle bore of the bottom plate brick.

(2) The realization of a dual door type rotary nozzle capable of easily and positively locking and releasing its inner and outer doors, and also capable of easily and safely opening and closing the doors.

(3) The realization of a dual door type rotary nozzle capable of easily opening and closing its outer door without the danger of any interference of, for example, an intermediate gear which is in mesh with a gear of a rotor accommodated within the outer door.

(4) The realization of a dual door type rotary nozzle capable of uniformly cooling a large number of coiled springs arranged within an outer door so as to force a slide plate brick against a bottom plate brick, whereby all the coiled springs are always caused to act on a rotor (and hence the slide plate brick) under the same condition, and the slide plate brick is pressed closely against the bottom fixed plate brick with a uniform force.

(5) The provision of a mechanism which is simple in construction yet capable of locking the threaded pins of a hinge for attaching an outer door including a slide plate brick and a rotor to a base member or the threaded pins of another hinge, for attaching an inner door including a bottom plate brick to the base member and which is also capable of effecting the fine adjustment of the brick position.

(6) The prevention of falling of a bottom or slide plate brick received in a supporting case or in a rotor with a simple construction.

(7) A base member is provided with a projection at a position symmetrical with a top nozzle receiving opening with respect to the center, the projection being adapted to be pressed against the upper surface of the bottom plate brick and corresponding to the back-up by a top nozzle, thus stabilizing the close contacting interfacial pressure between the bottom plate brick and a slide plate brick over the entire surface and preventing the entry of molten steel between the sliding surfaces thereby increasing the lives of the two bricks.

(8) The provision of a dual door type rotary nozzle so designed that the system on the whole is in the form of a unit, thus making it possible to attach and detach the system from a molten steel vessel easily in a very short period of time.

SUMMARY OF THE INVENTION

With a view to accomplishing the foregoing objects, the rotary nozzle system according to the invention has the following structural features.

(1) A dual door type rotary nozzle system for a metallurgical vessel, comprising:

a base member attached to the bottom shell of said vessel;

an inner door including a bottom plate brick having a plurality of nozzle bores, a support case maintaining therein said bottom plate brick in a relatively non-rotatable manner, a door frame surrounding said support case, first bearing means for rotatably supporting said support case within said door frame so as to manually rotate said bottom plate brick along with said support case when said inner door is opened, and first hinge means for pivotably connecting said door frame with said base member;

an outer door including a slide plate brick coacting with said bottom plate brick, a rotor maintaining therein said slide plate brick in a relatively non-rotatable manner and provided with a gear on the outer periphery thereof, frame means rotatably supporting said rotor by means of second bearing means, pressure means arranged within said frame means and exerting forces upon the lower surface of said rotor for pressing said slide plate brick toward said bottom plate brick, and second hinge means for pivotable connecting said frame means with said base member.

(2) The frame means is provided with a lock plate. Also, lock arms are pivotably attached to the base member so as to be engaged with the lock plate.

(3) The rotary nozzle is so constructed that the output from the speed reducer of the driving source is transmitted to the gear of the rotor through an intermediate gear, and the center distance between the rotor gear and the intermediate gear engaging with the former is selected to be greater than the sum of the radius of the pitch circle of the rotor gear and the radius of the pitch circle of the intermediate gear (hereinafter referred to as a standard center distance) by 0.6 to 1.0%. Also, cams are provided on the rotor and the frame means is provided with clamper receiving portions. With a clamper fitted in each clamper receiving portion, the rotor is rotated so that the clampers are engaged with the cams, and the rotor is lowered by an amount corresponding to at least 10 to 15% of the face width of the rotor gear, thereby opening and closing the outer door without any interference of the intermediate gear engaged with the rotor gear.

(4) A plurality of coiled springs are arranged within the frame means and a cooling medium is separately supplied to each of the coiled springs thereby substantially uniformly cooling the coiled springs.

(5) The first hinge for attaching the inner door to the base member, or the second hinge for attaching the outer door to the base member, comprises brackets each provided on the base member and having a threaded hole, arm portions each provided on the doors and having a cylindrical blind-end hole to be aligned with said threaded hole, a plurality of bolt holes arranged on said bracket at intervals of $\theta_1$ from the outer periphery toward the center of said threaded hole, threaded pins each consisting of a threaded portion adapted for threadedly engaging with the threaded holes of the bracket, a supporting shaft portion inserted into the end of said cylindrical blind-end hole for pivotably supporting the door frame or the frame means, a plurality of slots arranged at intervals of $\theta_2$ along the outer periphery of the threaded portion, and a bolt is threadedly fitted in one of the bolt holes so as to engage with one of the slots, and relation to be between the $\theta_1$ and $\theta_2$ is selected $\theta_1<\theta_2$ or $\theta_1>\theta_2$.

(6) In order to accommodate the bottom plate brick within the support case, or to accommodate the slide plate brick within the rotor, at least one cutout is formed in the inner surface of the case or the rotor, and a relatively fragile wedge of a heat resisting material is driven between the recess and the bottom or slide plate brick, thereby firmly holding the bottom or slide plate brick in place.

(7) The base member is provided with a projection adapted to be pressed against the bottom plate brick at a position which is substantially symmetrical with its top nozzle receiving opening with respect to the center thereof.

(8) A shim plate member is fastened to the bottom shell of the molten steel vessel by welding or the like and a plurality of studs are vertically fitted in the shim plate member and the holes formed in the base member are engaged with the bolts or nuts, thereby firmly holding the base member.

The above and other objects as well as advantageous features of the invention will become more clear from the following description taken in conjunction with the drawings.

DESCRIPTION OF THE PREFERRED EMBODIMENTS

Figure 1A:
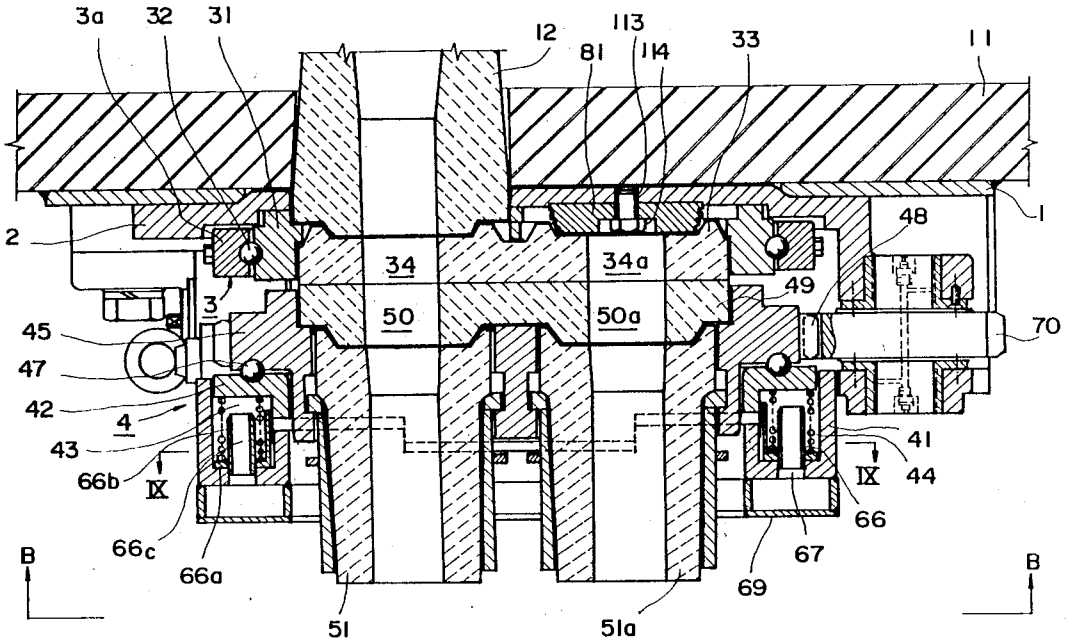
FIG. 1*a* is a longitudinal sectional view showing an embodiment of the invention.

The present invention will be first described briefly with reference to FIGS. 1*a*, 1*b*, 2*a*, 2*b* and 3. In the Figures, numeral 1 designates a shim plate attached to the bottom shell of a vessel 11 comprising a ladle, tundish or the like, and 2 a base member attached to the shim plate 1 and provided with two pairs of brackets 21, 21*a* and 22, 22*a* on the sides thereof. Numeral 3 designates an inner door including a door frame 3*a* having arms 35 and 35*a* a bottom plate support case 31 rotatably arranged internally through a ball bearing 32, and a bottom plate brick 33 is received in the bottom plate support case 31 in a relatively nonrotatable manner. Numerals 34 and 34*a* designate nozzle bores formed through the bottom plate brick 33. Numerals 23, 23*a* and 24, 24*a* respectively designate arms vertically mounted at a given interval on the inner side of the brackets 21 and 21*a*, respectively, and 27 and 27*a* lock arms each having a large-diameter portion at one end thereof, the arms 35 and 35*a* of the inner door 3 and the lock arms 27 and 27*a* being pivotably attached to the brackets 21 and 21*a* by threaded pins 28 and 28*a*, respectively (this pivot mechanism is hereinafter referred as a first hinge 30). Numeral 12 designates a top nozzle having its lower part projected through the openings formed through the bottom shell of the vessel 11, the shim plate 1 and the base member 2 and connected with the nozzle bore 34 (or 34*a*) of the bottom plate brick 33.

Numeral 4 designates an outer door, 41 an annular support frame having an L-shaped sectional shape and having arms 46 and 46*a*, and 42 a movable annular member having an L-shaped sectional shape and vertically movably arranged within the frame 41, the frame 41 and the movable member 42 forming an annular spring chamber 43 in which a plurality of coiled springs 44 are mounted, thereby pressing the movable annular member 42 upwardly. Note that the coiled springs may be replaced with cup springs or the like. Numeral 45 designates a rotor which is received in the frame 41, rotatably arranged on the movable annular member 42 through a ball bearing 47 and provided with a spur gear 48 which is an integral part of the outer surface thereof. Numeral 49 designates a slide plate brick received nonrotatably in the rotor 45, 50 and 50*a* nozzle bores in the slide plate brick 49, and 51 and 51*a* collector nozzles connected to the nozzle bores 50 and 50*a* respectively.

Formed on the upper surface of the rotor 45 are planar arcuate cams 52 and 52*a* provided at opposed positions to project from the upper surface of the rotor 45. Numerals 53 and 53*a* designate clamper receivers provided on the sides of the frame 41 to partly project from the upper surface of the frame 41, and through holes 54 and 54*a* for receiving clampers 55 are respectively formed through the clamper receivers 53 and 53*a* along the radial direction of the frame 41. As shown in the upper right part of FIG. 3, the clamper 55 comprises a wedge 56, a guide 57 and a handle 58. Numerals 59 and 59*a* designate lock plates provided on the sides of the clamper receiver 53 to project from the outer periphery of the frame 41, and notches 60 and 60*a* are provided at positions corresponding to the lock arms 27 and 27*a*, respectively.

The outer door 4 is pivotably attached to the brackets 22 and 22*a* of the base member 2 by threaded pins 61 and 61*a* through the arms 46 and 46*a* of the frame 41 (this pivot mechanism is hereinafter referred to as a second hinge 62). Numeral 70 designates an intermediate gear engaged with an output gear 71*a* of a speed reducer 71 and adapted to be driven by a driving source (not shown), such as a motor, so as to transmit its rotation to the gear 48 of the rotor 45 through the window portion of the frame 41.

Figure 3:
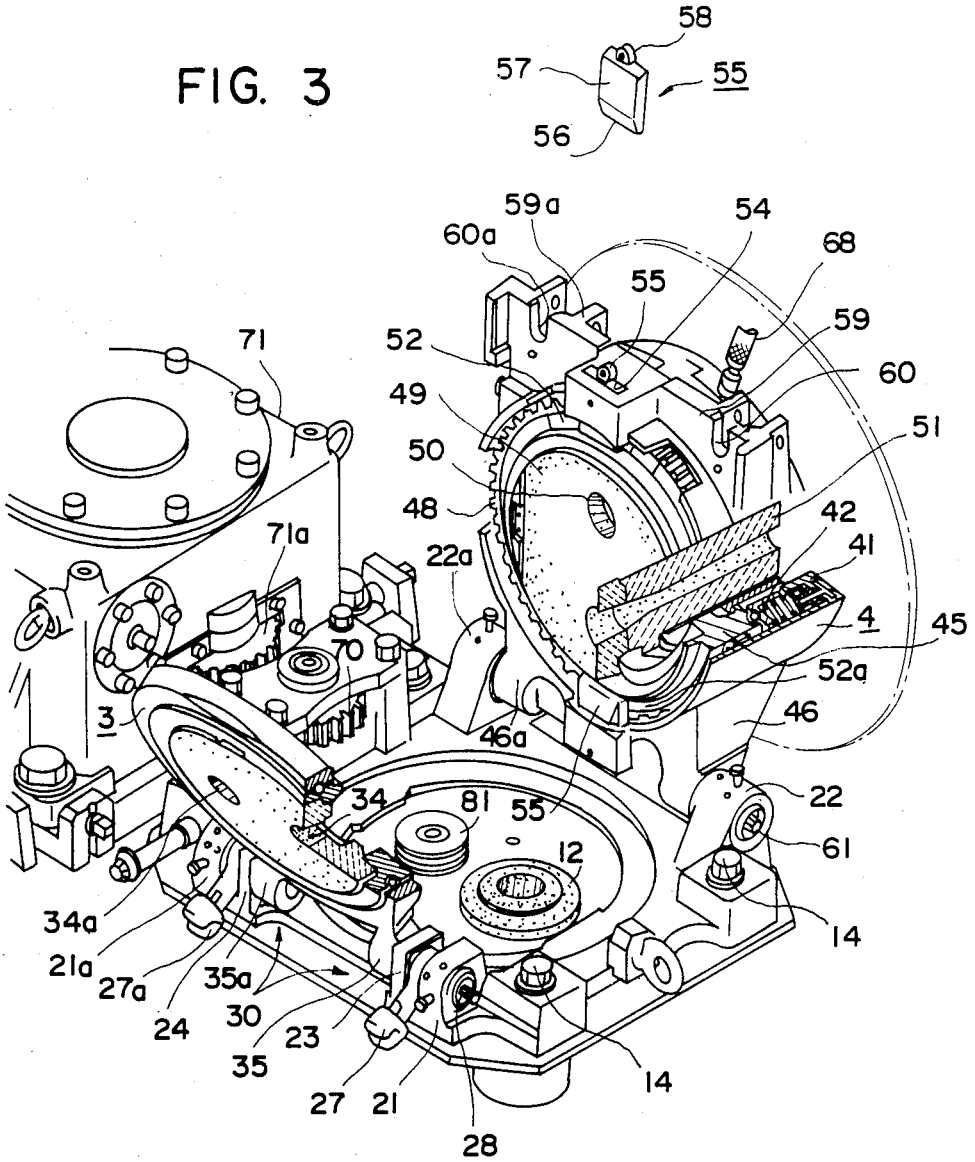
FIG. 3 is a perspective view of the embodiment showing the condition in which the doors are opened, with parts broken away for the sake of clarity.

With the construction described above, the dual door type rotary nozzle is used in the following manner to pour molten steel. After the inner door 3 including the bottom plate brick 33 has been closed, the outer door 4 is closed and the outer door 4 is locked by the lock arms 27 and 27*a*. Then, the rotor 45 is rotated by the output from the driving source through the intermediate gear 70 and then the clampers 55 are pulled off from the receivers 53 and 53*a*, thereby the slide plate brick 49 is rotated with the rotor 45 and the opening of the nozzle bores 34 and 50 is adjusted so that the molten steel is poured from the top nozzle 12. Also, in order to effect inspection, repair, replacement or the like of the bottom plate brick 33 or the slide plate brick 49, the clampers 55 are inserted into the receivers 53 and 53*a* and rotor 45 is rotated reversely so that the rotor 45 is pressed down to compress the springs 44 by the coaction of the cams 52, 52*a* and the clampers 55, 55*a*. Then the lock arms 27 and 27*a* are removed from the lock plates 59 and 59*a* and the outer door 4 is pivoted about the second hinge 62, thereby opening the second door 4. On the other hand, in order to effect the inspection, repair, replacement or the like of the bottom plate brick 33, the top nozzle 12 or the base member 2, the inner door 3 is pivoted about the first hinge 30 and opened as shown in FIG. 3.

Thus, in accordance with the above-described embodiment not only the outer door 4 containing the slide plate brick 49, but also the inner door 3 containing the bottom plate brick 33, can each be opened from the base member 2 by means of the hinge, and thus the manual rotation of the bottom plate brick for changing far nozzle bore and the inspection, adjustment or the like of the bottom plate brick, the top nozzle, and the base member, can be effected easily and quickly.

Next, a door clamping mechanism according to the present invention will be described with reference to FIGS. 3 to 5.

Figure 4:
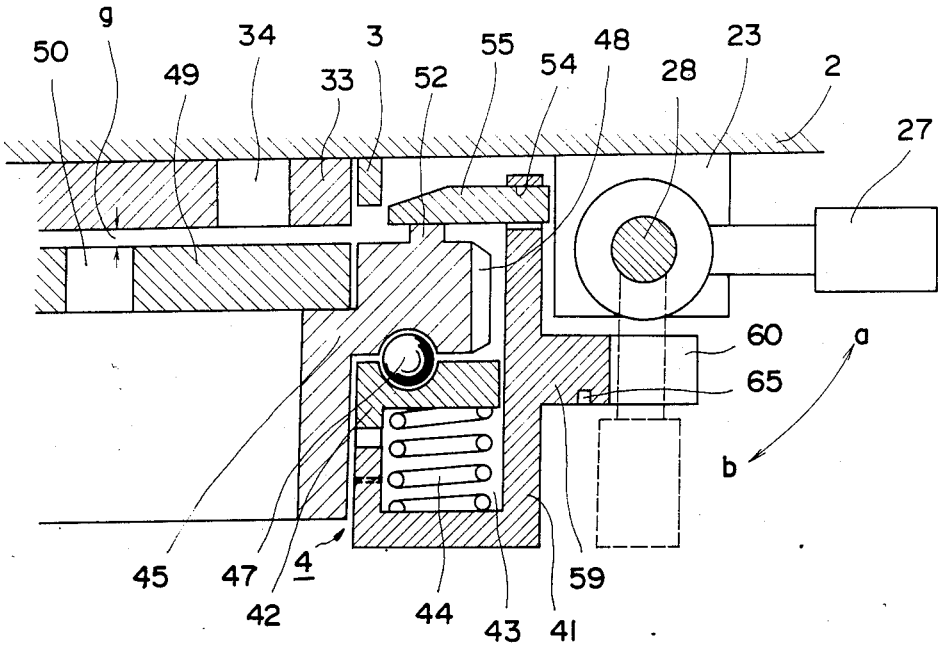
FIGS. 4 and 5 are longitudinal sectional views showing the function of a locking mechanism according to the invention.
Figure 5:
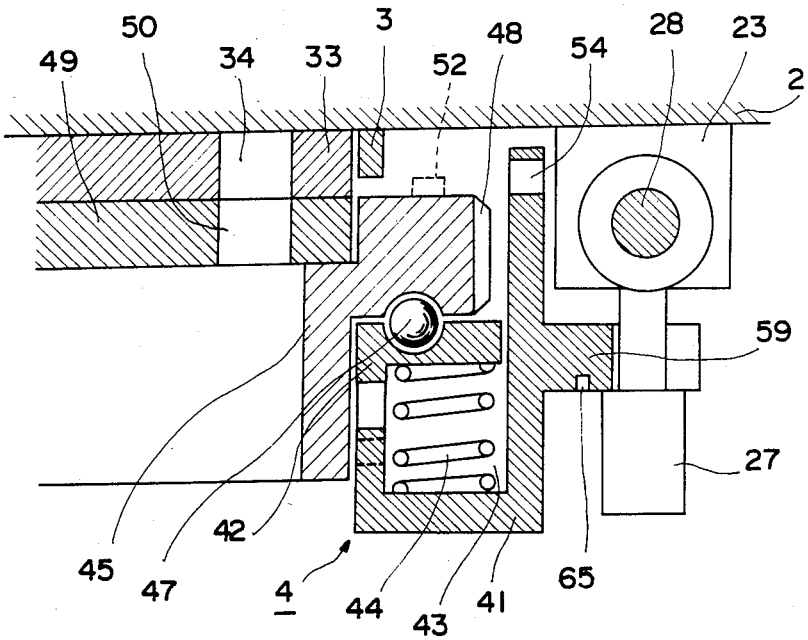

(1) In the case of opening the outer door 4:

As shown in FIG. 4, the clampers 55 are inserted into the clamper receiver holes 54 and 54*a* and then the rotor 45 is rotated through 90°, thereby bringing the nozzle bore 34 to its fully closed position. As a result, the cams 52 and 52*a* come under the clampers 55 so that the rotor 45 is forced downward and the coiled springs 44 are compressed. When this occurs, a gap g is produced between the bottom plate brick 33 and the slide plate brick 49. As a result, when the lock side of the frame 41 is pushed upward by hand, for example, the lock arms 27 and 27*a* are easily rotated in the direction of an arrow a and the lock is released. Then the outer door 4 is pivoted about the second hinge 62 thus opening the outer door 4.

(2) In the case of closing the outer door 4 to pour molten steel:

In the condition of FIG. 4, the lock side of the frame 41 is pushed upward so that the lock arms 27 and 27*a* are rotated in the direction of an arrow b, as shown by dotted lines, and are inserted into the notches 60 and 60*a* of the lock plates 59 and 59*a*, respectively. Then, the rotor 45 is rotated reversely through 90° so that the clampers 55 are disengaged with the cams 52 and 52*a* and the clampers 55 are removed. As a result, a shown in FIG. 5, the coiled springs 44 expand so that the rotor 45 is forced upward and the sliding surfaces of the bottom plate brick 33 and the slide plate brick 49 are brought into close contact. The resulting reaction force moves the frame 41 downward so that the large-diameter portions of the lock arms 27 and 27*a* are closely pressed against the lock plates 59 and 59*a*, respectively, and the outer door 4 is locked completely.

Figure 6:
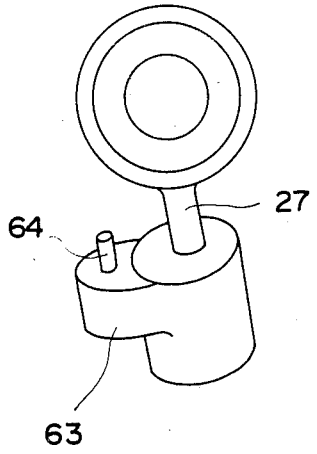
FIG. 6 is a perspective view showing another embodiment of the lock arm.

Note that by providing the large-diameter portion of each of the lock arms 27 and 27*a* with a block 63 having a projection 64 at the top as shown in FIG. 6, and by providing each of the lock plates 59 and 59*a* with a hole 65 so as to bring the projections 64 into engagement with the holes 65 of the lock plates 59 and 59*a*, it is possible to further enhance the locking effect.

Thus, in accordance with the locking mechanism of the present embodiment, it is possible to realize a rotary nozzle provided with a locking mechanism which is simple in construction and easy, positive and safe in operation. While in the case of the conventional door locked by means of pins about 60 seconds are required for opening the door, in accordance with the present invention only about 25 seconds are required and the operation time is reduced to less than one half. Further, while, in the past, the operators must directly touch the equipment for about 49 seconds, in accordance with the invention this time interval is reduced to about 10 seconds or one fourth.

Next, a mechanism for opening and closing the outer door without any interference of the intermediate gear, which meshes with the gear of the rotor, will be described.

Figure 7:
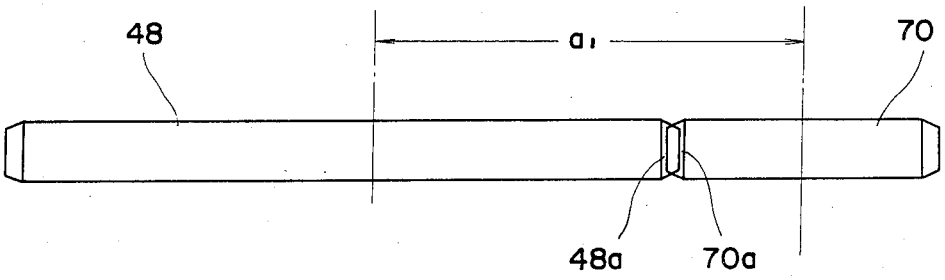
FIGS. 7 and 8 are schematic diagrams showing the relationship between the gear of the rotor and the intermediate gear according to the invention.

FIG. 7 is a schematic diagram showing the relationship between the gear 48 of the rotor 45 and the intermediate gear 70. In accordance with the present embodiment, the forward end of each tooth form of the gears 48 and 70 is slightly cut off obliquely. In this case, since the engaging position between the gear 48 and the intermediate gear 70 for opening the outer door 4 is substantially fixed, as regards the gear 48, only six to seven of the teeth which engage for opening the outer door 4 may be cut out obliquely. Also, in accordance with the present embodiment, the center distance $a_1$ between the gears 48 and 70 is selected slightly greater than the standard center distance $$a = \frac{Z_1 + Z_2}{2}$$

(where, $Z_1$ denotes the radius of the pitch circle of the gear 48, and $Z_2$ denotes the radius of the pitch circle of the intermediate gear 70.), and the top clearances 48*a* and 70*a* of the gears 48 and 70 are each selected slightly greater than the standard one.

The results of experiments showed that excellent results were obtained when the center distance $a_1$ between the gears 48 and 70 was selected to be greater than the standard center distance a by 0.6 to 1.0% and the top clearances 48*a* and 70*a* of the gears 48 and 70 were each selected to be 2 to 3 times the standard one.

In accordance with the embodiment, the gears 48 and 70 are constructed as follows.

| | Rotor gear (48) | Intermediate gear (70) |
|---|---|---|
| Pitch circle diameter | 552 mm | 192 mm |
| Module | 8 | 8 |
| Whole depth | 18 mm | 18 mm |
| Number of teeth | 69 | 24 |
| Center distance $a_1$ | 375 mm | |
| Face width | 50 mm | 50 mm |
| Pressure angle | 20° | 20° |

Figure 8:
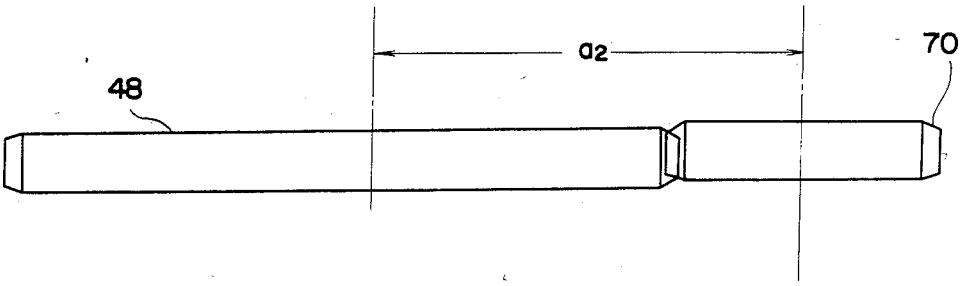

Even if the gears 48 and 70 are constructed as mentioned above, however, the attempt to pivot the outer door 4 about the second hinge 62 may fail to release the gear 48 due to the interference by the intermediate gear 70. In accordance with the present embodiment, as shown in FIG. 8. the gear 48 is lowered slightly by the coaction of the cams and the clampers so that the gear 48 is released without interfering with the intermediate gear 70, and hence the outer door 4 is opened and closed easily. The results of the experiments showed that excellent results were obtained by lowering the gear 48 by an amount corresponding to 10 to 15% of the face width thereof.

As previously explained in connection with FIGS. 3 to 5, the lowering action of the gear 48 is accomplished by inserting the clampers 55 into the holes 54 and 54*a* of the clamper receivers 53 and 53*a* of the outer door 4, rotating the rotor 45 through 90° to move the cams 52 and 52*a* under the clampers 55, forcing the rotor 45 including the slide plate brick 49 downward (by about 6 mm according to the present embodiment) and compressing the coiled springs 44.

In order to close the outer door 4, with the clampers 55 being inserted, the outer door 4 is pivoted so that the lock arms 27 and 27*a* are pivoted in the direction of the arrow b and are engaged with the notches 60 and 60*a* of the lock plates 59 and 59*a*, respectively, thus locking the outer door 4 (the condition of FIG. 4). At this time, the gear 48 does not interfere with the intermediate gear 70, and the outer door 4 is closed easily thus bringing the gear 48 into engagement with the intermediate gear 70. Then the gear 48 is rotated reversely through 90° by the driving source through the intermediate gear 70 so that the clampers 55 are disengaged with the cams 52 and 52*a*, and the clampers 55 then are removed. As a result, as shown in FIG. 5, the coiled springs 44 are expanded so that the rotor 45 is forced upward and the slide plate brick 49 is pressed closely against the sliding surface of the bottom plate brick 33, thus bringing the gear 48 into engagement with the intermediate gear 70 completely. On the other hand, the resulting reaction force forces the frame 41 downward so that the large-diameter portions of the lock arms 27 and 27*a* are pressed closely against the lock plates 59 and 59*a* and the outer door 4 is locked completely.

Thus, by virtue of the fact that the present embodiment is simple in construction, easy in operation and capable of opening and closing the outer door without removing or shifting the intermediate gear, its operation has improved effects in that the number of operators is reduced and that the operation time is significantly reduced.

Figure 9:
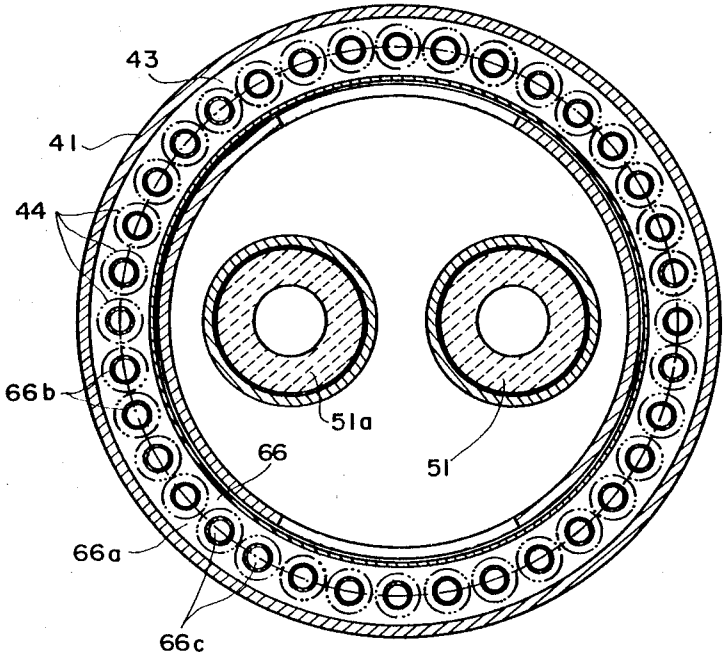
FIG. 9 is a cross-sectional view taken along the line IX—IX of FIG. 1*a*.
Figure 10:
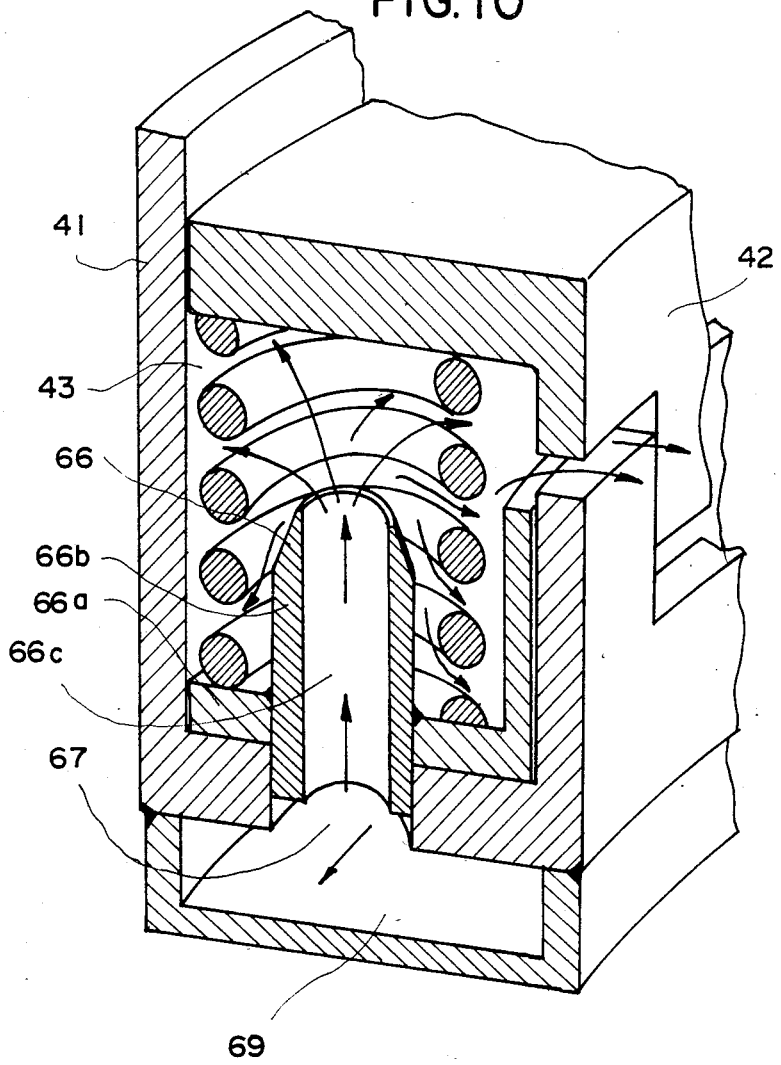
FIG. 10 is a perspective view of the principal part of FIG. 9.

Next, an embodiment of a cooling mechanism for the coiled springs will be described. In accordance with this embodiment, as shown in FIGS. 9 and 10, a seat ring 66, comprising a spring seat 66*a* and a plurality of guide portions 66*b* each formed with a hole 66*c* through the central portion thereof is provided for the number of the springs 44 within the spring chamber 43 formed by the frame 41 and the movable member 42 and an opening 67 is formed in the bottom portion of the frame 41 so as to communicate with the hole 66*c* of each guide portion 66*b*. Numeral 69 designates a pipe ring arranged along the lower surface of the frame 41 so as to communicate with the holes 67 formed in the bottom portion of the frame 41, and is connected by a hose 68 (see FIG. 3) to an air pressure source (not shown).

With the coiled spring cooling structure constructed as described above, the air supplied from the air pressure source for cooling purposes is supplied from the pipe ring 69 into the spring chamber 43 through the respective holes 67 of the frame 41 and the holes 66*c* of the guides 66*b*. This air passes through the spacing between the spring wires of each coiled spring 44 (the spacing becomes 1 to 2 mm upon compression in this embodiment) and it is discharged to the outside via the gaps between the movable member 42 and the frame 41, thereby maintaining the respective coiled springs at a given temperature.

This cooling operation is equally performed for all the coiled springs and therefore all the coiled springs are always placed under the same cooling condition. Thus, there is no danger of causing variations in performance among the coiled springs and the rotor and hence the slide plate brick is pressed with a uniform force, thereby uniformly pressing the slide plate brick closely against the bottom plate brick.

While, in the above description, the coiled springs are cooled by air, the coiled springs may be cooled by any other cooling medium than air.

In accordance with the present embodiment, the large number of coiled springs can be cooled separately and uniformly so that all the coiled springs are caused to function under the same condition and the slide plate brick is closely pressed against the bottom plate brick with a uniform force, thereby preventing the leakage of molten steel and the entry of air and increasing the lives of the bricks.

Figure 11:
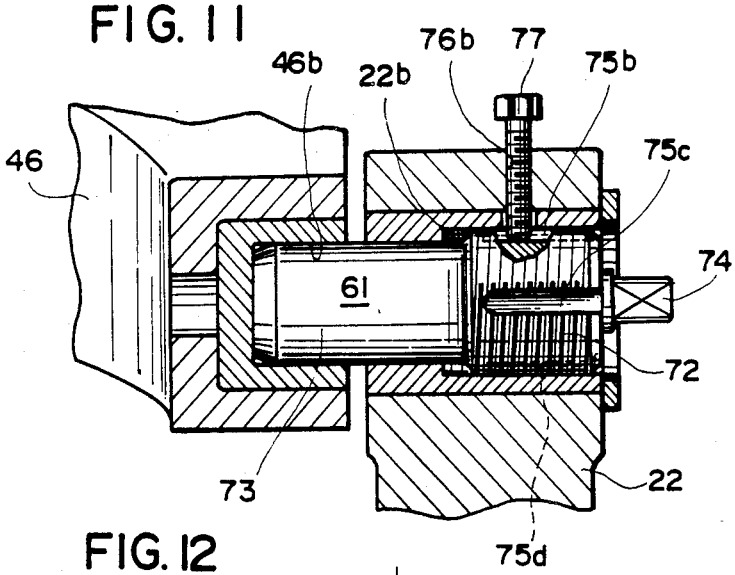
FIG. 11 is a longitudinal sectional view showing an embodiment of a threaded pin locking mechanism according to the invention.
Figure 12:
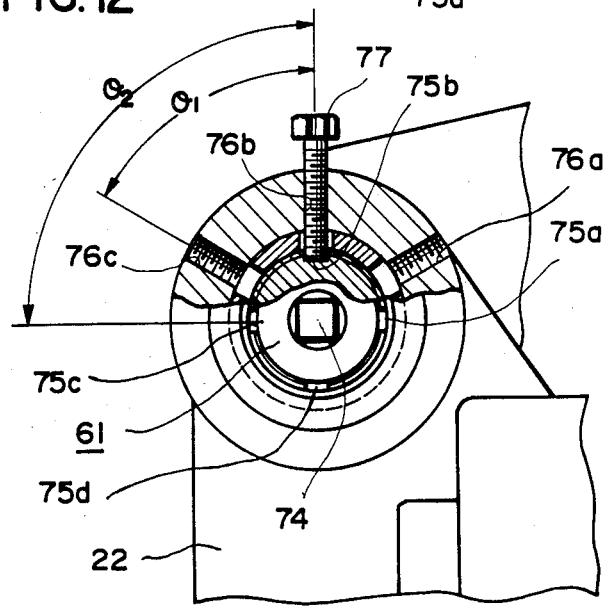
FIG. 12 is a front view of FIG. 11.

Next, a description will be made of a locking mechanism for the threaded pins 61 and 28 of the hinges 62 and 30 which respectively support the outer door 4 and the inner door 3 so they can be opened and closed as desired. Referring to FIGS. 11 and 12, numeral 22 designates the bracket of the base member 2, 22*b* a threaded hole formed in the bracket 22, 46 the arm of the outer door 4, 46*b* a cylindrical blind-end hole formed in the arm 46, and 61 the threaded pin comprising a threaded portion 72 and a supporting shaft portion 73. Said cylindrical blind hole 46*b* is aligned with the threaded hole 22*b* of the bracket 22. Numerals 76*a*, 76*b* and 76*c* designate bolt holes formed to extend from the outer surface of the bracket 22 toward the center of the threaded hole 22*b* and open to the threaded hole 22*b* and the interval between the bolt holes 76*a*, 76*b*, and 76*c* is selected, for example, $\theta_1=60°$. Numeral 77 designates bolts threadedly engaged with one of the bolt holes 76*a* to 76*c* selectively. Numeral 74 designates a square head provided at the end of the threaded pin 61, and 75*a*, 75*b*, 75*c* and 75*d* slots in the outer periphery of the threaded portion 72 at intervals of $\theta_2=90°$.

With the locking mechanism constructed as described so far, the threaded pin 61 is inserted into the threaded hole 22*b* from the right side in FIG. 11 so that the shaft portion 73 is inserted into the hole 46*b* formed in the arm 46 of the outer door 4, and the blind-end of the hole 46*b* is pushed by the end surface of the shaft portion 73 so that when the arm 46 of the outer door 4 is pushed to substantially a given position, one of the bolt holes 76*a* to 76*c* of the bracket (e.g., the bolt hole 76*b*) closest to one of the slots (e.g., the slot 75*b*) is selected and the threaded pin 61 is slightly turned to the right or left to align the selected bolt hole 76*b* with the slot 75*b*. Then, the bolt 77 is threadedly fitted in the bolt hole 76*b* and its forward end is engaged with the slot 75*b*, thus locking the threaded pin 61 at its position.

After a long period of use, or the like, when the bracket 22 or the arm 46 is deformed slightly so that the outer door 4 is no longer accurately aligned with the inner door 3, the bolt 77 is loosened to disengage it with the slot 75*a* and the square head 74 is held by a spanner, or the like, to turn the threaded pin 61 to the right or left back into the initial position. Then, one of the bolt holes (e.g., the bolt hole 76*c*) is aligned with the nearest slot (e.g., the slot 75*c*) and the bolt 77 is threadedly fitted in the bolt hole 76*c* thereby again accurately aligning the outer door 4 with the inner door 3.

Figure 1B:
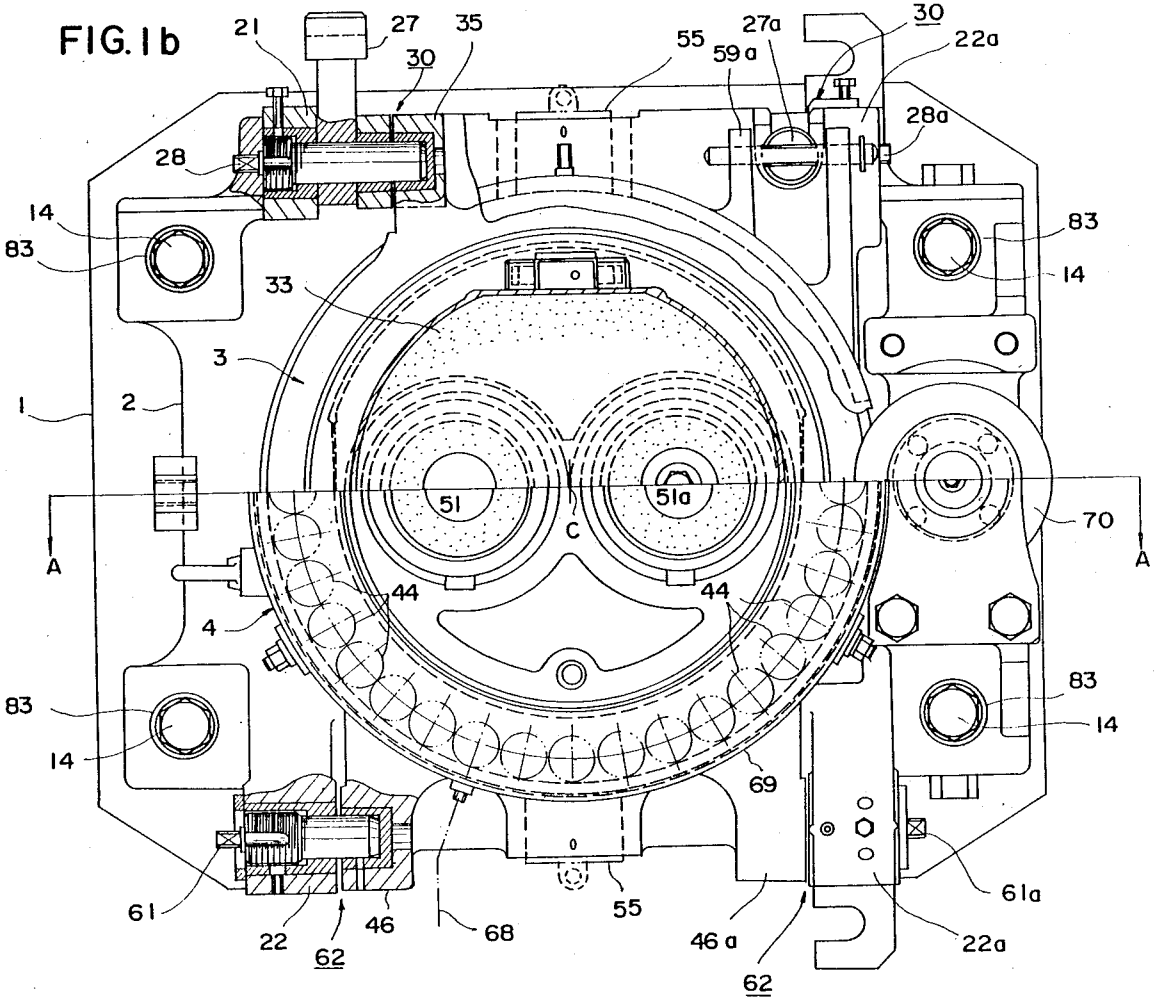
FIG. 1*b* is a bottom end view taken in the direction of the arrows substantially along the line B—B in FIG. 1*a*, with parts broken away and in section for the sake of clarity.

In accordance with this embodiment, by virtue of the fact that the above-described locking mechanisms are provided for the second hinge 62, which rotatably mounts the outer door 4 to the brackets 22 and 22*a* of the base member 2, the second door 4 and hence the slide plate brick 49 can always be held in the proper position by adjusting the threaded pins 61 and 61*a*, and thus the bricks 33 and 49 can be accurately aligned and held in close contact with each other. While, in FIGS. 11 and 12, the locking mechanisms are provided for the second hinge 62 of the outer door 4, it is needless to say that similar locking mechanisms may also be provided for the first hinge 30 of the inner door 3 as shown in FIG. 1*b*.

In this embodiment, the threaded portion 72 of the threaded pin 61 (61*a*) is formed with a thread having a pitch of 6 mm. The reason for using this coarse pitch is to prevent any burning fitting due to the radiation heat (about 300° C.) and simplify the operation. In the case of the conventional system, if the threaded pins 61 and 61*a* having the pitch of 6 mm are rotated once, the arms 46 and 46*a* (hence the outer door 4) are each moved by 6 mm thus making it impossible to make a fine adjustment. In accordance with this embodiment, however, the turning of the threaded pin 61 by $$\frac{\theta_2 - \theta_1}{360}$$

or 1/12 of a rotation (at $\theta_1=60°$, $\theta_2=90°$), brings the bolt 77 into engagement with one of the slots 75*a* to 75*d* and in this way a minimum displacement of 0.5 mm for the arms 46 and 46*a* (hence the outer door 4) is ensured, thus making it possible to effect very fine adjustments.

While in the above-described embodiments each threaded pin is formed with four slots at intervals of $\theta_2=90°$ and each threaded hole is formed with three bolt holes at intervals of $\theta_1=60°$, the present invention is not intended to be limited thereto and the relation between $\theta_1$ and $\theta_2$ may be changed to $\theta_1>\theta_2$. Namely, in accordance with the invention the numbers of slots and bolt holes as well as their angles may be selected as desired in dependence on the circumstances provided that the relation $\theta_1<\theta_2$ or $\theta_1>\theta_2$ is satisfied. However, to provide excessively large numbers of slots and bolt holes is not preferable from a strength point of view.

Figure 13:
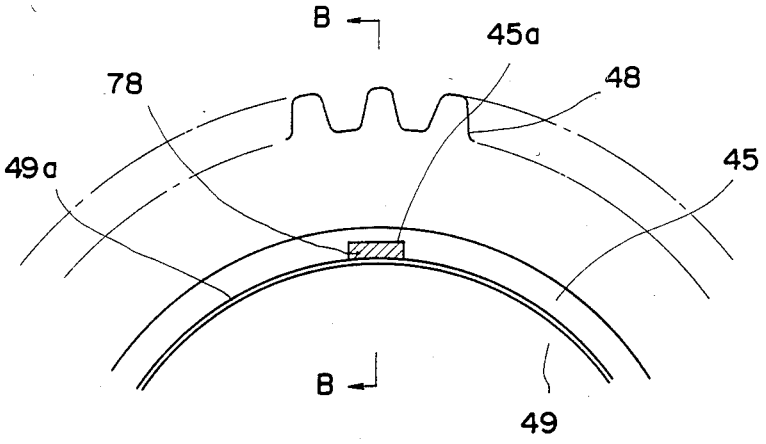
FIG. 13 is a plan view showing the principal part of an embodiment of a slide plate brick retention mechanism according to the invention.
Figure 14:
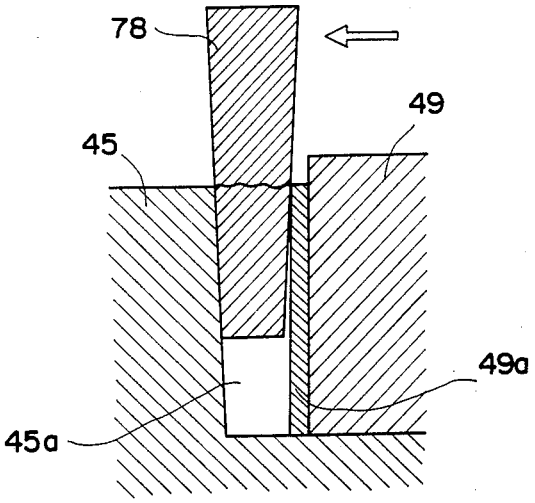
FIG. 14 is a fragmentary sectional view taken along the line B—B of FIG. 13.

FIG. 13 is a partial plan view showing a holding mechanism for the bottom or slide plate brick and FIG. 14 is a sectional view taken along the line B—B of FIG. 13. In the Figures, numeral 45 designates the rotor, 48 the gear, and 49 the slide plate brick. Numeral 49*a* designates a steel band disposed between the slide plate brick 49 and the rotor 45, and is not essential. Numeral 45*a* designates a recess formed in the inner periphery of the rotor 45 and it may be provided at two or more places, although only a single recess is shown in the Figures. Numeral 78 designates a wedge made, for example, of carbon-filled bakelite or heat resisting synthetic resin, thinner in the lower part than in the upper part and relatively fragile by shock.

With this embodiment, after the slide plate brick 49 has been received in the rotor 45, the wedge 78 is driven into the recess 45*a* to firmly hold the slide plate brick 49 in place, and then its upper part is struck from the side as shown by an arrow in FIG. 14 with a hammer or the like to break it to substantially the same height as the upper surface of the rotor 45. While the wedge 78 may be made of any other heat resisting material than carbon-filled bakelite and heat resisting synthetic resins, it should preferably be made of a material which will be broken easily even if it falls off and enters any part of the gear 48. Further, while the wedge 78 may be of a size such that it becomes substantially flush with the upper surface of the rotor 45, the operating efficiency will be improved by using an oversized wedge 78 so that after the wedge 78 has been driven into the recess 45*a*, the projected portion is hit from the side with a hammer or the like and broken off.

While, in FIGS. 13 and 14, the slide plate brick 49 is firmly held by the wedge 78 with the rotor 45, it is needless to say that the bottom plate brick 33 may also be firmly held by a wedge with the support case 31.

With the construction described above, this embodiment is capable of easily holding the bottom or slide plate brick in place firmly with a simple construction and preventing these bricks from falling off during the opening and closing of the inner or outer door. Thus, this embodiment has very great effects from the points of view of safety and economy.

Figure 15:
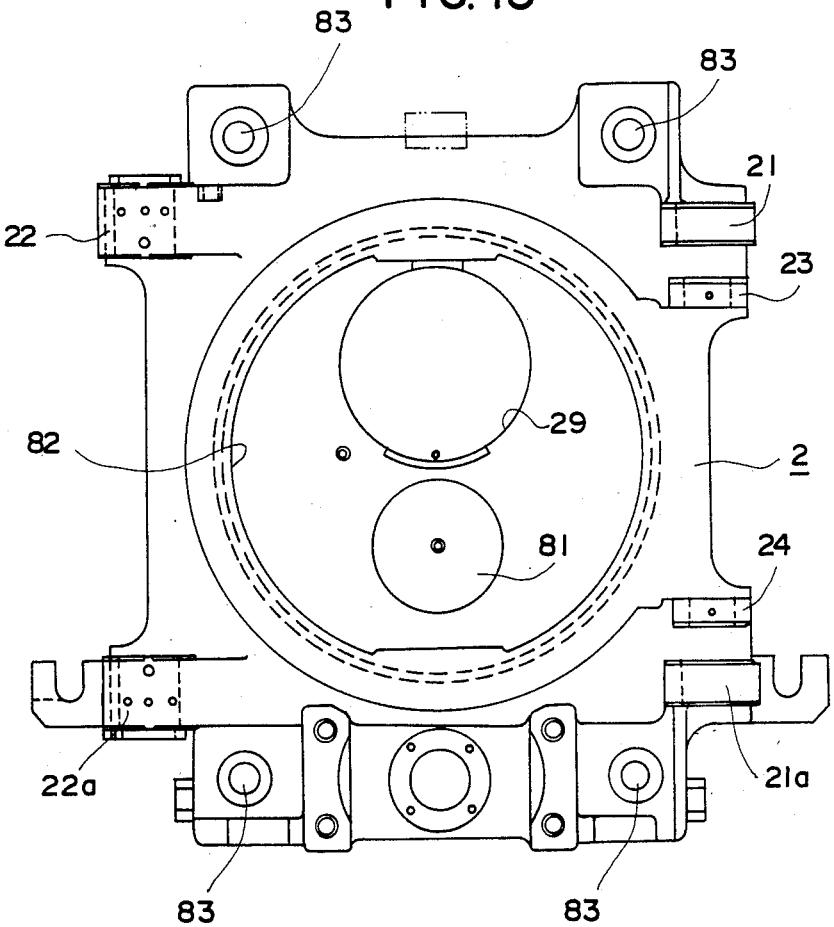
FIG. 15 is a plan view showing an embodiment of the base member according to the invention.
Figure 16:
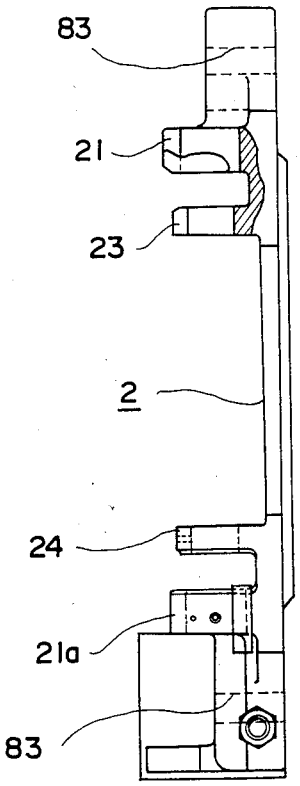
FIG. 16 is a side view of FIG. 15.

Next, an embodiment of a mechanism for stabilizing the interfacial pressure between a bottom plate brick and a slide plate brick will be described. FIGS. 15 to 20 show a base member, an inner door and a bottom plate brick according to the embodiment. As shown in FIGS. 15 and 16, the base member 2 is centrally formed with a portion 82 for receiving the inner door 3, and provided in the receiving portion 82 are an opening 29 for receiving the lower part of the top nozzle 12 and a projection 81 at a position symmetrical with the opening 29 with respect to the center of the portion 82 for backing up the bottom plate brick 33. The projection 81 is formed to have a height such that when the projection 81 is fitted inside a ridge portion 86 or 86*a* formed along the outer periphery of a nozzle bore 34 or 34*a* of the bottom plate brick 33 (see FIG. 20), and the bottom plate brick 33 is arranged in a given position, the projection 81 is pressed against the inner upper surface of the ridge portion 86 (or 86*a*) in place of the top nozzle (see FIG. 1*a*). Numerals 21 and 21*a* designate brackets to which arms 35 and 35*a* of the inner door 3 are respectively attached rotatably, 22 and 22*a* are brackets to which the arms 46 and 46*a* of the frame 41 are attached rotatably, and 83 are holes for attaching the base member 2 to the vessel 11.

Figure 17:
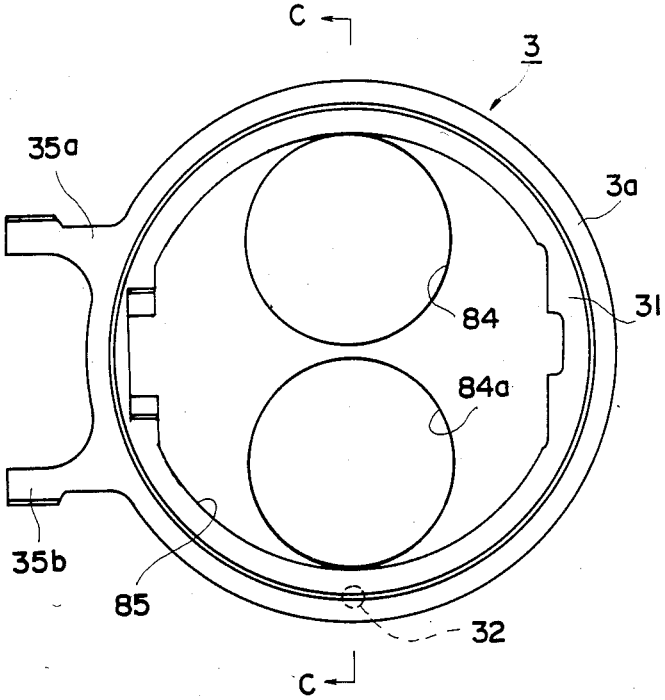
FIG. 17 is a plan view showing an embodiment of the first door used with the invention.
Figure 18:
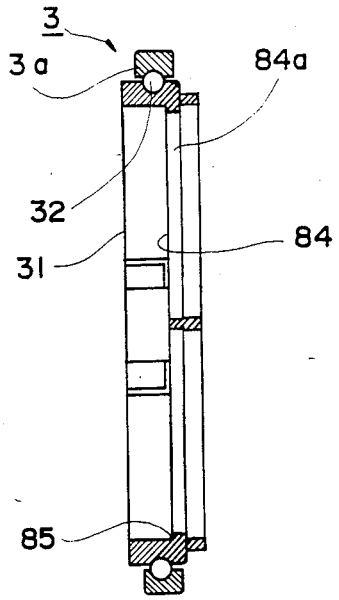
FIG. 18 is a sectional view taken along the line C—C of FIG. 17.
Figure 19:
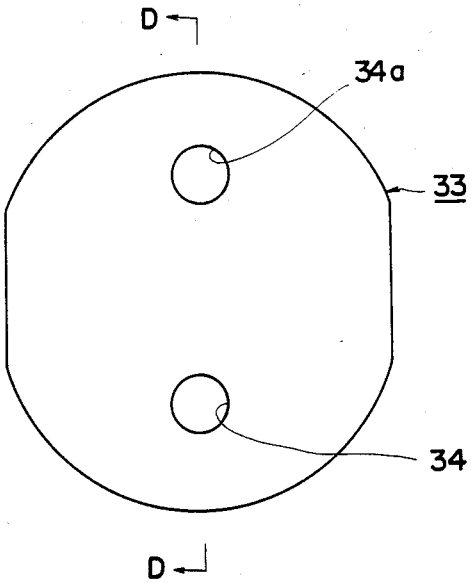
FIG. 19 is a plan view showing an embodiment of the bottom plate brick.
Figure 20:
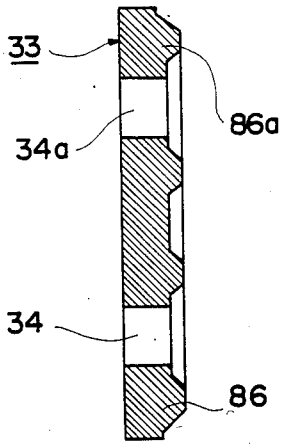
FIG. 20 is a sectional view taken along the line D—D of FIG. 19.

As shown in FIGS. 17 and 18, the inner door 3 comprises a door frame 3*a* having arms 35 and 35*a*, and a bottom plate support case 31 rotatably disposed within the door frame 3*a* through a ball bearing 32, and the bottom plate support case 31 is formed with holes 84 and 84*a* for respectively receiving the ridge portions 86 and 86*a* formed along the outer periphery of the nozzle bores 34 and 34*a* of the bottom plate brick 33, and a stepped portion 85 having an oval-shaped periphery with a pair of flat portions and adapted for receiving the bottom plate brick 33. On the other hand, as shown in FIGS. 19 and 20, the bottom plate brick 33 is formed into an oval shape with the sides forming flat portions and it includes the two nozzle bores 34 and 34*a* formed at symmetrical positions, and ridge portions 86 and 86*a* formed on the upper surface so as to be concentric with the nozzle bores 34 and 34*a*, respectively.

With the embodiment constructed as described above, when the inner door 3 and the outer door 4 are closed and are locked by the lock arms 27 and 27*a*, the sliding surface of the slide plate brick 49 is forced into close contact with the sliding surface of the bottom plate brick 33 by the coiled springs 44. In this case, as shown in FIG. 1*a*, one of the nozzle bores of the bottom plate brick 33, e.g., the nozzle bore 34 is pressed against and backed up by the top nozzle 12 and the other nozzle bore, e.g., the nozzle bore 34*a* is pressed against and backed up by the projection 81 attached on the base member 2. Thus, the sliding surfaces are uniformly pressed closely against each other all over the surfaces, and therefore there is no danger of causing any gap or deformation. When it is desired to change the nozzle bores 34 and 34*a*, the outer door 4 is opened first, then the inner door 30 is pivoted about the first hinge 30 to open it and finally the bottom plate support case 31 is rotated through 180° by hand.

In accordance with the rotary nozzle system constructed as described above, the sliding surfaces of the bottom plate brick and the slide plate brick can be held in close contact all over the surfaces with a stable interfacial pressure. This has the effect of preventing the entry of molten steel and any deformation of the bottom plate brick, and thereby greatly increases the life of the bottom plate brick and the slide plate brick, respectively.

Figure 2A:
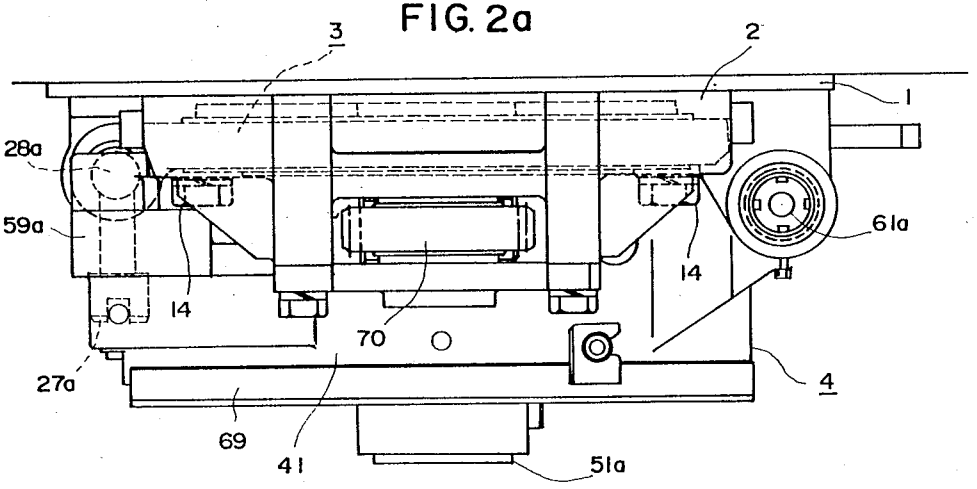
FIG. 2*a* is a front elevational view of the embodiment showing the condition in which the doors are closed.
Figure 2B:
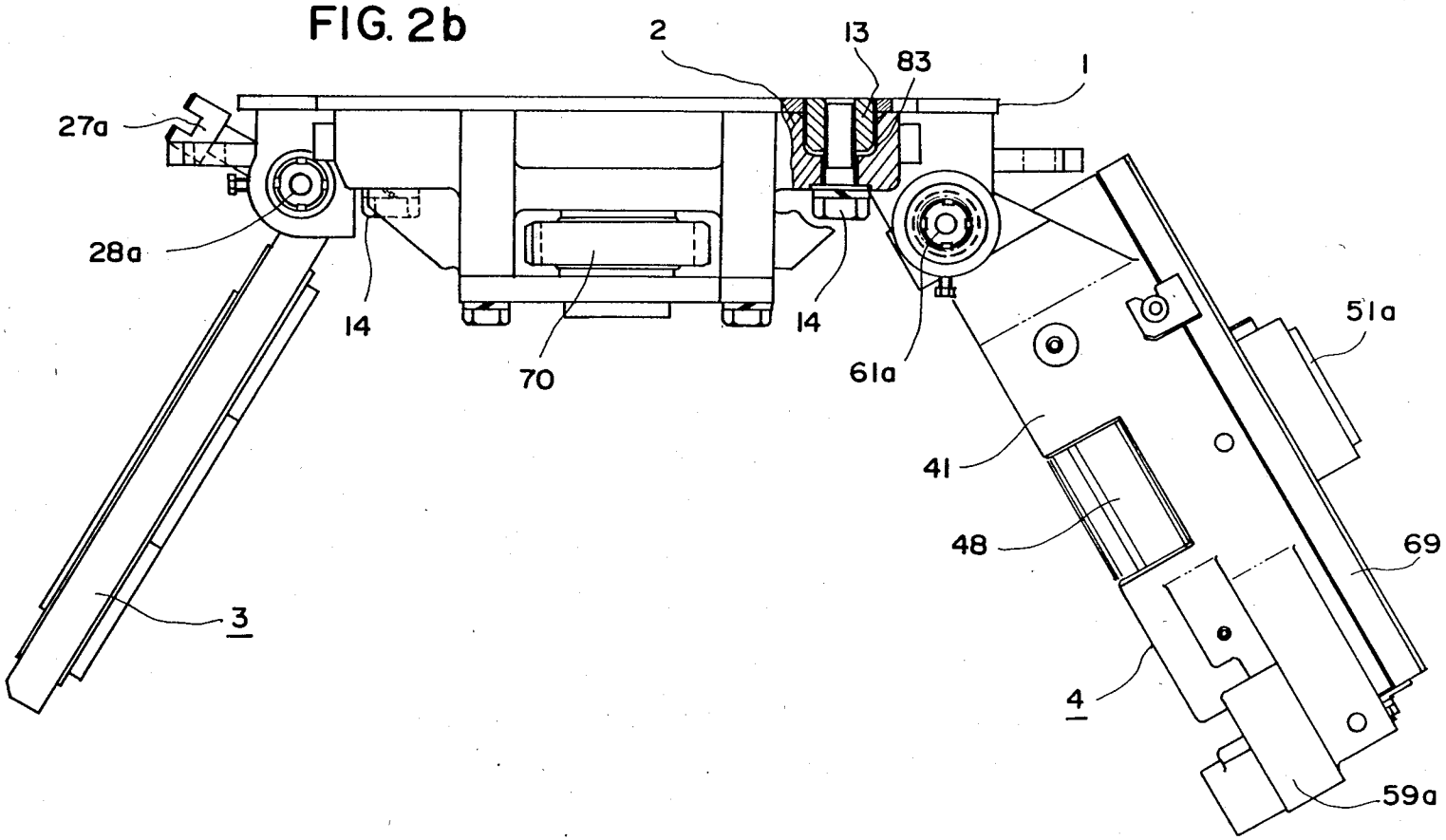
FIG. 2*b* is a front elevational view of the embodiment showing the condition in which the doors are opened.

Next, an embodiment of a structure for mounting the base member to the bottom shell of the vessel will be described. In accordance with this embodiment, as shown in FIGS. 1*b* and 2*b*, the shim plate 1 is attached to the bottom shell of the vessel 11 by welding, or the like, and a stud 13 having a threaded hole is vertically fitted in each of the positions (FIG. 2*b*) corresponding to the holes 83 of the base member 2 shown in FIGS. 1*b* and 15, and the studs 13 fitted in the holes 83 of the base member 2 are held in position with bolts 14.

With the dual door type rotary nozzle constructed as above described, the inspection, repair or replacement of the slide plate brick 49 and the bottom plate brick 33 can be effected by simply opening the outer door 4 and/or the inner door 3, and it is also possible to remove the bolts 14 and take out the base member 2 as a unit in a like manner as a block type unit. Therefore, the inspection, repair, or replacement of the respective component parts can be effected easily and rapidly and moreover there is no danger of impeding the operation due to an interruption of service over a long period of time.

While the preferred embodiments of the invention have been described in detail, the invention is not intended to be limited thereto. For instance, while the bottom plate brick and the slide plate brick are each formed with two nozzle bores, each of the bricks may be formed with three or more nozzle bores. Also, the other component parts may be suitably modified in shape, construction, so as not to depart from the spirit and scope of the invention.

What is claimed is:

1. A dual door type nozzle system for a metallurgical vessel, comprising:

a base member positioned below the bottom sheet of said vessel;

an inner door including a bottom plate brick having a plurality of nozzle bores, a support case maintaining therein said bottom plate brick in a relatively non-rotatable manner, a door frame surrounding said support case, first bearing means for rotatably supporting said support case within said door frame so as to manually rotate said bottom plate brick along with said support case when said inner door is opened, and first hinge means for pivotably connecting said door frame with said base member;

an outer door including a slide plate brick coacting with said bottom plate brick, a rotor maintaining therein said slide plate brick in a relatively nonrotatable manner and provided with a gear on the outer periphery thereof, frame means rotatably supporting said rotor by means of second bearing means, pressure means arranged within said frame means and exerting forces upon the lower surface of said rotor for pressing said slide plate brick toward said bottom plate brick, and second hinge means for pivotably connecting said frame means with said base member, wherein said nozzle system includes an intermediate gear in meshing engagement with said rotor gear and wherein said rotor gear is adapted to be driven from a reducer of a driving source through said intermediate gear, a center distance between said rotor gear and said intermediate gear engaging with said rotor gear being selected to be greater than the sum of the radius of a pitch circle of said rotor gear and the radius of a pitch circle of said intermediate gear by 0.6 to 1.0%, said rotor being provided with a plurality of cams, said frame means being provided with a plurality of clamper receivers, whereby when a clamper is inserted into each of said clamper receivers and said rotor is rotated, each of said cams is engaged with one of said clampers and said rotor is lowered, along with said slide plate brick, at least by an amount corresponding to 10 to 15% of a face width of said rotor gear, thus lowering said rotor gear against said pressure means and thereby opening and closing said outer door without interference by said intermediate gear engaging with said rotor gear.

2. A dual door rotary nozzle system according to claim 1, wherein said frame means includes a lock plate, and wherein said base member includes a lock arm pivotably attached for engagement with said lock plate.

3. A dual door type rotary nozzle system according to claim 1, wherein said pressure means comprises a plurality of springs arranged within said frame means, and wherein a cooling medium is separately supplied to each of said springs thereby substantially uniformly cooling all of said springs.

4. A dual door type rotary nozzle system according to claim 1, wherein one of said support case and said rotor is provided with at least one recess in an inner peripheral surface thereof, and wherein a wedge made of a heat resisting material is driven between said recess and said bottom or slide plate brick, thereby firmly holding said brick in place.

5. A dual door type rotary nozzle system according to claim 1, wherein a shim plate member is secured to the bottom shell of said vessel, wherein a plurality of studs are vertically fitted in said shim plate member, and wherein a plurality of holes are formed in said base member, whereby each of said studs is fitted in one of said holes thereby firmly holding said base member in place.

6. A dual door type rotary nozzle system for a metallurgical vessel, comprising:

a base member positioned below the bottom shell of said vessel;

an inner door including a bottom plate brick having a plurality of nozzle bores, a support case maintaining therein said bottom plate brick in a relatively non-rotatable manner, a door frame surrounding said support case, first bearing means for rotatably supporting said support case within said door frame so as to manually rotate said bottom plate brick along with said support case when said inner door is opened, and first hinge means for pivotably connecting said door frame with said base member;

an outer door including a slide plate brick coacting with said bottom plate brick, a rotor maintaining therein said slide plate brick in a relatively nonrotatable manner and provided with a gear on the outer periphery thereof, frame means rotatably supporting said rotor by means of second bearing means, pressure means arranged within said frame means and exerting forces upon the lower surface of said rotor for pressing said slide plate brick toward said bottom plate brick, and second hinge means for pivotably connecting said frame means with said base member, wherein one of said first and second hinge means comprises a plurality of brackets each formed on said base member and having a threaded hole, a plurality of arm portions each provided on one of the inner and the outer door and each having a cylindrical blind-end hole for alignment with one of said threaded holes, a plurality of bolt holes arranged on said bracket at intervals of an angle $\theta_1$ to extend from an outer periphery toward a center of each of said threaded holes, a plurality of threaded pins each comprising a threaded portion for threadedly engaging with one of said threaded holes, and a supporting shaft portion inserted into the end of said cylindrical blind-end hole for pivotably supporting said door, each said threaded portion being formed along an outer periphery thereof with a plurality of slots arranged at intervals of an angle $\theta_2$, and at least one bolt threadedly fitted in one of said bolt holes so as to engage with one of said slots, and wherein the relation between said angles $\theta_1$ and $\theta_2$ is selected to be one of $\theta_1<\theta_2$ and $\theta_1>\theta_2$.

7. A dual door type rotary nozzle system according to claim 6, wherein said frame means includes a lock plate, and wherein said base member includes a lock arm pivotably attached for engagement with said lock plate.

8. A dual door type rotary nozzle system according to claim 6, wherein said pressure means comprises a plurality of springs arranged within said frame means, and wherein a cooling medium is separately supplied to each of said springs thereby substantially uniformly cooling all of said springs.

9. A dual door type rotary nozzle system according to claim 6, wherein one said support case and said rotor is provided with at least one recess in an inner peripheral surface thereof, and wherein a wedge made of a heat resisting material is driven between said recess and said bottom or slide plate brick, thereby firmly holding said brick in place.

10. A dual door type rotary nozzle system according to claim 6, wherein a shim plate member is secured to the bottom shell of said vessel, wherein a plurality of studs are vertically fitted in said shim plate member, and wherein a plurality of holes are formed in said base member, whereby each of said studs is fitted in one of said holes, thereby firmly holding said base member in place.

11. A dual door type rotary nozzle system for a metallurgical vessel, comprising:

a base member positioned below the bottom shell of said vessel;

an inner door including a bottom plate brick having a plurality of nozzle bores, a support case maintaining therein said bottom plate brick in a relatively non-rotatable manner, a door frame surrounding said support case, first bearing means for rotatably supporting said support case within said door frame so as to manually rotate said bottom plate brick along with said support case when said inner door is opened, and first hinge means for pivotably connecting said door frame with said base member;

an outer door including a slide plate brick coacting with said bottom plate brick, a rotor maintaining therein said slide plate brick in a relatively nonrotatable manner and provided with a gear on the outer periphery thereof, frame means rotatably supporting said rotor by means of second bearing means, pressure means arranged within said frame means and exerting forces upon the lower surface of said rotor for pressing said slide plate brick toward said bottom plate brick, and second hinge means for pivotably connecting said frame means with said base member, wherein said base member is formed with an opening for receiving a lower part of a top nozzle and includes a projection arranged at a position corresponding to an unused nozzle bore of said bottom plate brick, said bottom plate brick including a recess corresponding in shape with and adapted to receive said projection so as to be borne against said bottom plate brick to prevent rotation of said support case relative to said inner door frame when said inner door is closed.

12. A dual door type rotary nozzle system according to claim 11, wherein said frame means includes a lock plate, and wherein said base member includes a lock arm pivotably attached for engagement with said lock plate.

13. A dual door rotary nozzle system according to claim 11, wherein said pressure means comprises a plurality of springs arranged within said frame means, and wherein a cooling medium is separately supplied to each of said springs thereby substantially uniformly cooling all of said springs.

14. A dual door type rotary nozzle system according to claim 11, wherein one of said support case and said rotor is provided with at least one recess in an inner peripheral surface thereof, and wherein a wedge made of a heat resisting material is driven between said recess and said bottom or slide plate brick, thereby firmly holding said brick in place.

15. A dual door type rotary nozzle system according to claim 11, wherein a shim plate member is secured to the bottom shell of said vessel, wherein a plurality of studs are vertically fitted in said shim plate member, and wherein a plurality of holes are formed in said base member, whereby each of said studs is fitted in one of said holes, thereby firmly holding said base member in place.

* * * * *